United States Patent [19]

Pardini et al.

[11] 4,375,021

[45] Feb. 22, 1983

[54] RAPID ELECTRIC-ARC EXTINGUISHING ASSEMBLY IN CIRCUIT-BREAKING DEVICES SUCH AS ELECTRIC CIRCUIT BREAKERS

[75] Inventors: Franco P. Pardini; Francesco De Vizzi, both of Milan, Italy

[73] Assignee: General Electric Company, New York, N.Y.

[21] Appl. No.: 217,062

[22] Filed: Dec. 16, 1980

[30] Foreign Application Priority Data

Jan. 31, 1980 [IT] Italy ..... 19591 A/80

[51] Int. Cl.[3] ..... H01H 33/10

[52] U.S. Cl. ..... 200/147 B; 200/144 R; 200/147 R

[58] Field of Search ..... 200/147 A, 147 B, 147 R, 200/144 R

[56] References Cited

U.S. PATENT DOCUMENTS

| | | | |
|---|---|---|---|
| 2,293,487 | 8/1942 | Bartlett | 200/147 R |
| 2,337,949 | 12/1943 | Walle | 200/147 A |
| 2,378,124 | 6/1945 | Bolsterli | 200/147 R |
| 2,945,109 | 7/1960 | Fehling | 200/147 R |
| 3,369,095 | 2/1968 | Maggi | 200/147 A |

FOREIGN PATENT DOCUMENTS

| | | | |
|---|---|---|---|
| 699933 | 12/1965 | Italy | 200/147 B |
| 205859 | 7/1966 | Switzerland | 200/147 B |
| 560257 | 3/1944 | United Kingdom | 200/147 B |

*Primary Examiner*—Robert S. Macon

*Attorney, Agent, or Firm*—R. A. Menelly; W. C. Bernkopf; F. Jacob

[57] ABSTRACT

A rapid arc extinguishing assembly includes an arc chute comprising a large number of essentially parallel deionizing plates each in form of thin magnetically permeable, electrically conductive plates bent in U-shape, with the curve of the U facing the circuit breaker contacts and the arms thereof insulated from each other by a thin insulation sheet. To promote arc extinction by the arc chute and accelerated breaker contact separation, the breaker contacts are flanked by a magnetic assembly comprising opposed columns of parallel, spaced ferromagnetic plates embedded in an insulating material. The columns may be magnetically coupled by a yoke to create a closed slot in which the breaker movable contact travels.

13 Claims, 19 Drawing Figures

RAPID ELECTRIC-ARC EXTINGUISHING ASSEMBLY IN CIRCUIT-BREAKING DEVICES SUCH AS ELECTRIC CIRCUIT BREAKERS

BACKGROUND OF THE INVENTION

The present invention is directed to the extinction of electric arcs in electric circuit breakers, particularly current-limiting electric circuit breakers.

A current-limiting circuit breaker is generally understood to be that type of high current interrupting capacity circuit breaker capable of substantially limiting the duration and the intensity of current destined to flow in a circuit experiencing a short circuit fault. To limit the duration and the intensity of short-circuit currents, a circuit breaker must, within the shortest possible time, separate its contacts and extinguish the resulting electric arcs.

To promote a better understanding of current limiting, the following definitions are set forth. "Presumed short circuit current" is that current which would flow in a circuit subjected to a short circuit fault, i.e., a fault whose impedance is essentially zero. The magnitude of the presumed short circuit current depends upon the impedance of the circuit upstream from the short circuit fault and the current available of the source feeding the fault. "Effective short circuit current" is the actual short circuit current that is let through by the circuit breaker during its interruption process. "Interruption time" of a circuit breaker is the time taken by the circuit breaker to interrupt a short-circuit current from its inception and is composed of the sum of the "intervention time" (the time required to effect breaker contact separation) and the "arc time" (the time required to fully extinguish the resulting arc). "Arc voltage" is the voltage appearing across the footpoints of the arc, which is in opposition to the source driving voltage and thus acts to diminish the magnitude of the effective or let-through short circuit current. From this it is seen that the higher the arc voltage, the lower the magnitude of the effective short circuit current the circuit breaker lets through.

Thus, a current-limiting circuit breaker must operate such as to shorten both the time of intervention and the time of extinction of the arc by increasing arc voltage in a very short time, on the order of milliseconds.

A known solution for limiting the duration and magnitude of effective short circuit current is to use current-limiting fuses designed to effect interruption of the circuit and extinction of the resulting arc within the requisite short time. While this solution is rather effective, it suffers from the grave disadvantage that the fuses must be replaced after each interruption and, in the case of a three-phase circuit, a so-called "single phasing" situation is created if only one of the three fuses blows. To remedy the latter negative aspect, it is known to integrate such fuses with a circuit breaker having a modest interrupting capacity, such that the circuit breaker is automatically tripped open to interrupt all of its three poles in response to the blowing of any one of the fuses. However, it does not avoid the need to replace blown fuses and is somewhat expensive.

Another approach to current limitation is to use high-speed actuators of the electromagnetic type, such as described in U.S. Pat. No. 1,763,502. Such actuators act directly on the breaker contacts to effect their separation whenever the line current flowing through it exceeds a predetermined value.

Still another approach resides in utilizing the electrodynamic forces associated with the currents feeding the breaker contacts being made to flow in opposite directions along closely spaced parallel paths and thereby develop repulsion forces effective in achieving rapid contact separation. This approach has been variously and differently applied at times and can be effective from the point of view of intervention time and rapidity of contact separation. However, there remains the very considerable problem of rapidly extinguishing the arc.

Swift extinction of the arc usually entails the resort to electromagnetic or pneumatic means for motivating the arc so as to increase its path length, promote removal of the arc from the breaker contacts, and facilitate cooling and splitting up of the arc; all contributing to increasing the arc voltage to a value in excess of the system driving voltage.

Among the devices for achieving ultimate quenching of the arc, the most typical is an arc chute having a given number of superimposed ferromagnetic plates separated from one another and provided with appendices or horns embracing the path of the arc drawn between the contacts. This plate configuration is effective in drawing the arc into the arc chute where it is cooled and split up into a plurality of arclets. Another type of arc chute is formed of metallic plates bent in U-shape, with the curve of the U facing the contacts, such as illustrated in U.S. Pat. No. 1,925,858. These patent plates should promote a more intense electrodynamic action on the arc due to the currents flowing in the arms of the U. However, from the patent description it does not appear that especially favorable results were obtained, and, in order to avoid plate damage, it is suggested that they be coated with a highly conductive material, such as copper.

The apparent failure of this type of U-shaped plate may be explained by the fact that the plates are necessarily of a considerable thickness, thus limiting the number of plates that can be physically accommodated in a typical arc chute. Consequently the ability of the arc chute to cool and split up the arc pursuant to effecting an ultimate quench is diminished.

It is accordingly an object of the present invention to provide an improved current-limiting electric circuit breaker of high current interrupting capacity.

Another object is to provide a current-limiting circuit breaker of the above character which is equipped with improved means for rapidly extinguishing the arcs drawn between the breaker contacts.

An additional object is to provide a current limiting circuit breaker of the above character which is further equipped with improved means for motivating the arc into the arc extinguishing means.

Yet another object is to provide a current-limiting circuit breaker which is efficient in construction, compact in size and reliable in operation.

SUMMARY OF THE INVENTION

In accordance with the present invention, there is provided a current-limiting circuit breaker having improved arc handling means consisting of an arc deionizing assembly and a magnetic arc motivating or motoring assembly.

The deionizing assembly comprises an arc chute having a large number of deionizing plates of thin magnetic material, preferably of high electrical resistivity, each having a U-shaped configuration, with the curve of the U facing the contacts and the arms of the U insulated from one another by a thin insulating sheet.

As mentioned above, U-shaped arc plates have been known in the past. However, these prior art plates have a different structure and are of considerable thickness. The deionizing U-shaped plates of the present invention, in contrast, are extremely thin, and thus it becomes possible to accommodate in a given space a larger number of plates. The instant U-shaped plates are very effective in that the arc, upon impinging on the plates, is split into a series of individual arclets drawn between adjacent plates; the current feeding these arclets being forced to follow the U-shaped path afforded by the plates. This is in contrast to conventional arc plate constructions, wherein the arclets actually pierce the plates, with arc current flowing directly through the plates. The U-shaped arc current path created by the instant arc plate construction is effective in generating intense electrodynamic forces exerted on the arclets to accelerate their movement deeper into the arc chute.

The magnetic arc motoring assembly comprises plates predominantly of magnetic material exercising a function similar to that of the horns or arc straddling projections of the deionizing plates known in the art. The magnetic plates form two columns which flank the arc drawn between the contacts. The said two columns may be surmounted by a transverse, flux coupling yoke consisting of magnetic material. The purpose of the transverse yoke is to enhance the flux flow between the lateral columns which is created by the current passing through the conductor or arm supporting the moving contact. The plates of the columns are imbedded in an insulating material to maintain them in parallel, spaced relation, and thus there is created an arc confinement chamber disposed in confronting relation with the arc chute. The magnetic arc motoring assembly fulfills the dual functions of propelling the arc drawn between the contacts into the arc chute and between the U-shape plates thereof where the arc is rapidly extinguished and of accelerating the opening movement of the contact arm by virtue of the electrodynamic forces associates with short circuit currents. This electrodynamic action includes the electromagnetic action attributed to the fact that the movable contact arm moves within the slot formed by the two lateral columns and toward the transverse yoke. This action is analogous to the well-known "slot effect" found in induction motors whose field windings are disposed in open slots formed in magnetic field pieces. This electromagnetic effect enhances the extremely rapid separation of the breaker contacts and, due to the gapped plate construction of the magnetic assembly, the flux density and thus the electromagnetic effect increases as the movable contact arm approaches its open position.

The lateral magnetic columns combine with the arc chute plates to provide a flux circuit predominantly of magnetic material capable of enhancing the linkage with the arc so that the arc is rapidly propelled into the arc chute.

The increased rapidity of contact opening, and the increased rapidity with which the arc is motivated toward the arc chute and between the individual deionizing arc plates thereof result in a decrease in the total time of interruption, thereby drastically limiting the effective or let-through short circuit current relative to the presumed short circuit current. The smaller current intensity and the smaller time of arc travel into and between the deionizing plates reduce the destructive effects of the arc on the arc plates. Thus the U-shaped arc plates can be made thinner and accommodated in greater number than has heretofore been possible.

The insulating material in which the magnetic arc motoring assembly plates are embedded, in addition to forming an arc confinement chamber, prevents the arc from rooting and becoming stationary on these plates and, if of certain known compositions, may under the effects of the high arc temperature violently generate gases or vapors exercising an effective pneumatic action on the arc to enhance its motivation into the arc chute.

DESCRIPTION OF THE DRAWINGS

The aforeindicated and subsequently mentioned objects and advantages of the present invention will be better understood with the help of the following detailed description taken in conjunction with the annexed drawings, wherein.

DETAILED DESCRIPTION

Figure 1:
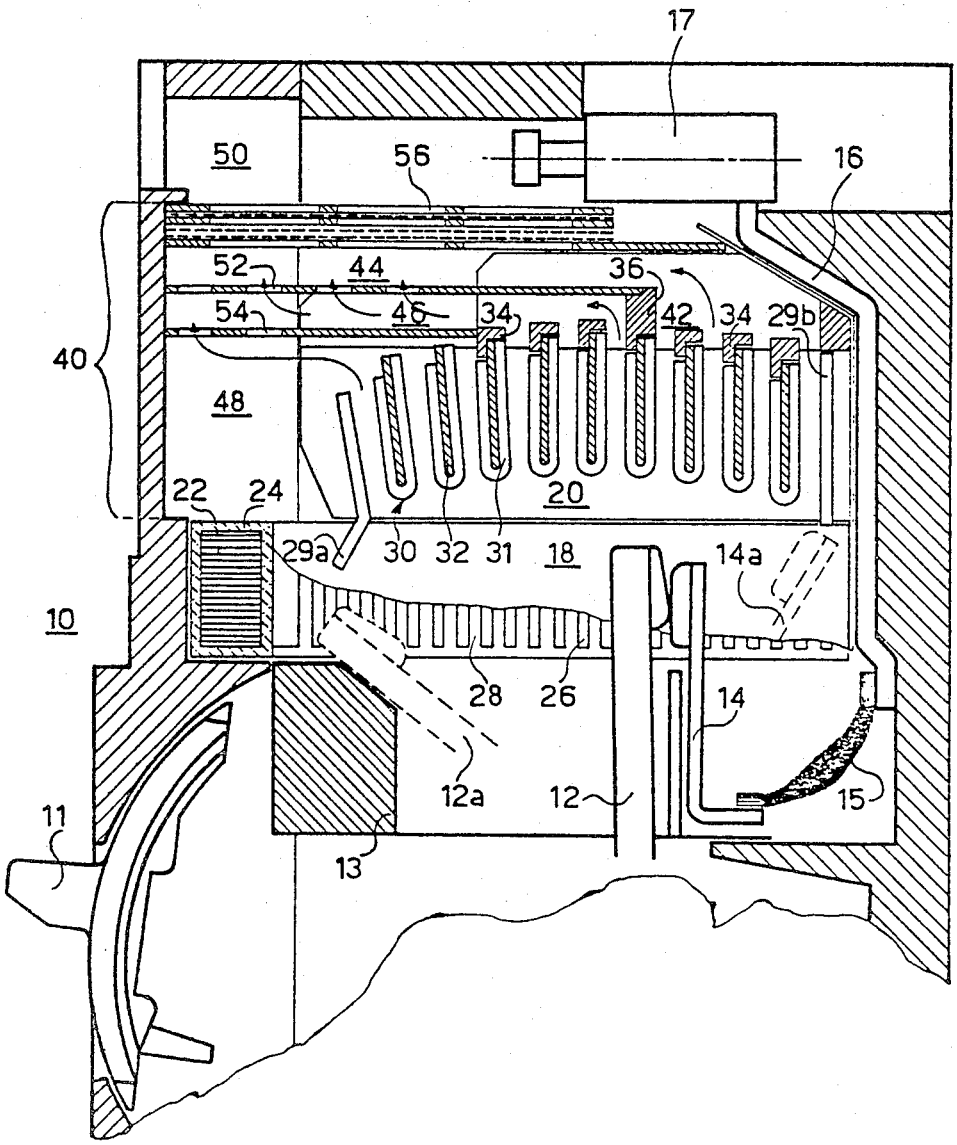
FIG. 1 shows a partial section of a current-limiting circuit breaker constructed in accordance with the present invention.

Referring to FIG. 1, a circuit breaker 10, constructed in accordance with the present invention, includes an external handle 11 for articulating an operating mechanism, not shown, to manually open and close the breaker contacts, one carried by an elongated movable contact arm 12 and the other by a fixed or semifixed, elongated contact arm 14. FIG. 1 also shows the contact arms 12 and 14, following opening due to electrodynamic repulsing forces such as manifested during a short circuit, in their respective open positions 12*a* and 14*a* wherein contact arm 12 comes to rest against a shock absorbing stop 13 of insulating material, and contact arm 14 is stopped by a similar abutment, now shown. Contact arm 14 is connected by means of a flexible conductor 15 to a rigid conductor 16 and thence to a terminal 17 facilitating connection of the circuit breaker with an external circuit. Obviously, contact arm 12 is connected via similar conductors to an externally accessible terminal, not shown.

The pair of circuit interrupting contacts is flanked by a magnetic motoring assembly 18 whose purpose it is to propel an arc drawn between these contacts as they separate into an arc quenching chute or deionizing assembly 20. In particular, the assembly 18 includes a transverse yoke 22 composed of solid magnetic material, or preferably laminated, magnetic material insulated by means of a coating 24, and of two columns—of which only one is visible in FIG. 1—composed of a stacked array of plates 26 of magnetic material. Each of the plates is formed of one or more laminations and are insulated from one another by insulating layers 28 formed of the same material as the coating 24 which, in addition to the yoke 22, also covers the exterior of the two columns.

The arc quenching chute 20 contains two simple end plates 29*a* and 29*b* and a given number of doubled deionizing plates 30 composed of a sheet 31 of electrically conducting and magnetic material bent in U-shape with a thin insulating sheet 32 interposed between the arms of the U. The bent U-plates have offset ends, whereas the insulating sheet extends over all of the larger surface of the longer arm of the U. In the absence of insulation between the said staggered ends, arcs blown into chute 20 and arriving at the backs of those plates in the lower portion of the chute, prior to being extinguished, can stabilize between the back edges 31*a* and 31*b* of the plates (FIG. 6), thereby shunting the preferred U-shaped arc current path through each plate. To further discourage the establishment of stable arcs between the back edges 31*a* and 31*b* of the plates, intervening insulating elements 34 may be utilized.

The chute 20 communicates with a damping and expansion chamber 40 wherein the exhausting gases or vapors generated by the arc can expand and slow down, thus to avoid any significant back pressure tending to reduce the rate of progress of the arc through to the back of the arc chute. The chamber 40 is subdivided into a series of expansion subchambers 42, 44, 46 and 48. Subchamber 44 is separated from subchamber 46 by an insulative element 36 and a perforated panel 52 and from subchamber 48 by one of the insulating elements 34 and a perforated panel 54. Subchamber 44 communicates by way of a compound panel 56, comprising perforated metallic walls with sheets of sound-absorbing material interposed, with an exhaust chamber 50 open towards the outside for final discharge of the gases or vapors.

Figure 2:
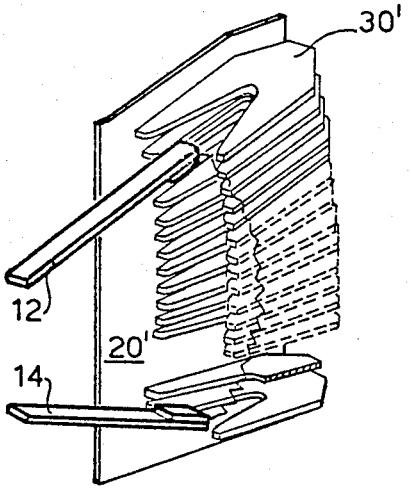
FIGS. 2 and 3 are, respectively, a view in perspective and a lateral sectional view of a prior art arc chute.
Figure 3:
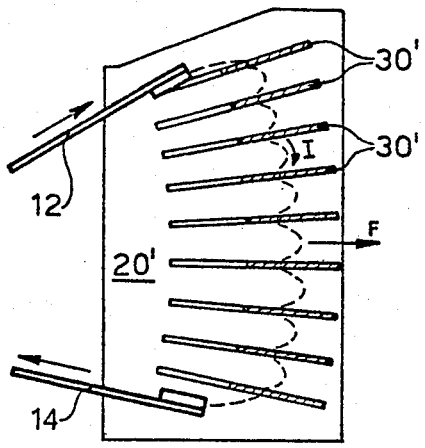
Figure 4:
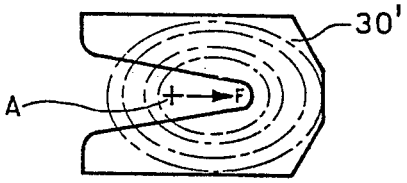
FIG. 4 shows a plan view of a typical deionizing plate configuration employed in prior art arc chutes.

A comparison of FIGS. 2 through 7 will provide a better understanding of the improved performance of arc chute 20. FIGS. 2 and 3 illustrate a conventional arc chute 20' commonly employed in the prior art. This arc chute includes a plurality of deionizing plates 30' which, composed of magnetic metallic material and having bifurcated shape (see FIG. 4), tend to propel the arc A formed between the opening contacts in the direction of arrow F towards the yoke formed by the plate proper. Here the arc is hopefully split into arclets which progress to the back of the chute (FIG. 3), all the while being cooled down on contact with the plates 30' and elongated to promote extinction. The electrodynamic force acting on the arc is due to the arc current I itself. As may be seen, the arcs passing through and between the deionizing plates become increasingly removed or outwardly bowed relative to the direct line path between the separated contacts, and thus the blowout force acting on the arcs is diminished.

Figure 5:
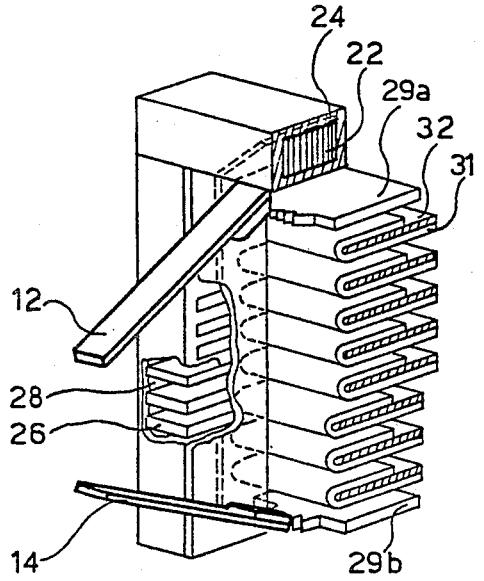
FIGS. 5 and 6 show, respectively, a view in perspective and a view in lateral section of the combination arc motivating and extinguishing assemblies utilized in the circuit breaker of FIG. 1.
Figure 6:
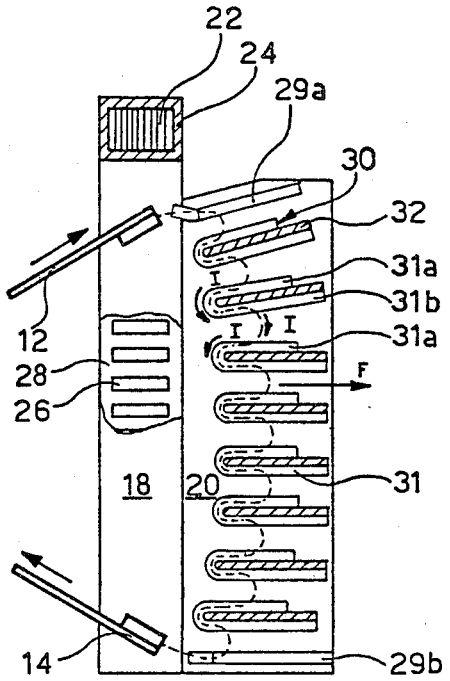
Figure 7:
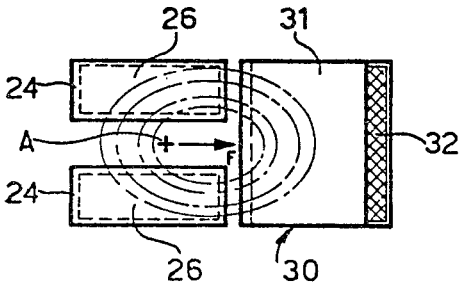
FIG. 7 is a plan view illustrating the effect of magnetic blowout in propelling the arc into the arc extinguishing assembly.
Figure 8B:
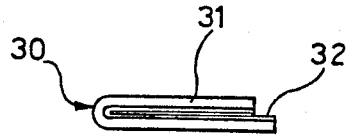
FIGS. 8*a* and 8*b* are, respectively, plan and sectional views of a deionizing arc plate constructed in accordance with one embodiment of the invention.

FIGS. 5 and 6 illustrate the action achieved by the present invention utilizing magnetic arc motoring assembly 18 and arc quenching chute 20. The magnetic plates 26 of assembly 18 are preferably thicker than the arc chute plates 30 so as to increase the density of iron in the arc flanking columns and are not necessarily aligned with the arc chute plates 30. However, as shown in FIG. 7, two magnetic plates 26 together with one deionizing arc plate 30 achieve a magnetic effect, analogous to the prior art deionizing arc plate 30' (FIG. 4), but is more effective in forcing the arc A to move rapidly in accordance with the arrow F until it encounters the deionizing plates 30. Once the arc has encountered these plates 30, its movement toward the rear of the arc chute 20 becomes more rapid due to the electrodynamic action associated with the arc current flowing through the U-shaped deionizing plates.

The structure and functioning of the deionizing plates 30 will now be explained in detail with reference to FIG. 6. The plates are formed of a sheet of metallic magnetic material 31 which is bent in a U-shape. To preclude arcing between these arms of the U there is provided a very thin, intervening insulating layer 32, either laminated to the arc plate sheet prior to its being formed in U-shape or inserted between the arms as a separate insulative sheet. Thus, it becomes apparent that the arc current I flows through the upper arm of each plate 30 in one direction and the lower arm in the opposite direction. The space between adjacent plates is affected by a magnetic field generated by the current in the arms, thus producing an especially strong electrodynamic effect on the arc, pushing it at great speed toward the back of arc chute 20. Moreover, as mentioned above, this effect increases as the arc advances rearwardly, contrary to what occurs in an arc chute with traditional plates, wherein the electrodynamic action decreases as the arc bows outwardly away from the contacts. Another effect due to the arc plate construction of the present invention is that the current flowing in the curved portions of the U-shaped plates may be considered as portions of a current path in close, parallel relation to the contact opening path, i.e., similar to a conductor extending between the contacts and carrying current exercising an electrodynamic action which contributes, in the final analysis, to the opening movement of the contacts.

A curved deionizing plate has been known for some time—see, e.g., the aforementioned U.S. Pat. No. 1,925,858. However, this prior art arc plate construction is considered not to be particularly effective, especially as regards effective arc extinction; one reason being that the arc plates of this patent are composed of ferromagnetic material having a substantially greater thickness than the arc plates of the present invention. Moreover, the separation between the prior art arc plates is greater, and thus, coupled with the increased plate thickness, limits the number of plates accommodatable in a given arc chute. Thus the electrodynamic effects on the arc became too modest in the prior art arc chute construction to bring about rapid arc displacement and quenching.

Moreover, the breaking-up or splitting of the arc is substantially increased in comparison with the arc chute disclosed in the above-noted patent. The considerable thickness of the prior art plates is dictated by the need to limit the heating-up thereof and to prevent destruction through the high energy transferred to them during the considerable time period during which the arc is maintained. In order to minimize this condition, the aforementioned patent provides for coating the magnetic material of the plates with materials which are good electric conductors and good conductors of heat, such as copper, for the specific purpose of reducing the heating caused by the arc.

The features of the present invention, including the enhanced propulsion of the main arc into the arc chute 20, the interposition of a thin insulating layer 32 between the arms of the U-shaped plates, the reduction of arc plate thickness thereby providing for an increase in their number, all contribute to extremely short arc staying times—a few milliseconds—and a noteworthy limitation of the effective current relative to the presumed short circuit current. Consequently, there is achieved a reduction in the thermal energy supplied to the plates during the arcing, and thus damage thereto is avoided, even if a ferromagnetic material of small thickness and high resistivity is used.

Figure 9B:
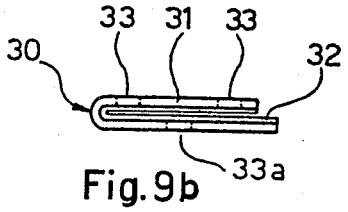
FIGS. 9*a* and 9*b* are, respectively, plan and sectional views of an alternative deionizing arc plate construction.
Figure 8A:
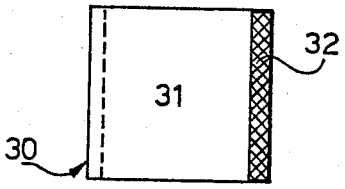
Figure 9A:
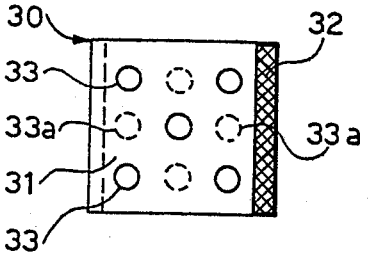
Figure 10B:
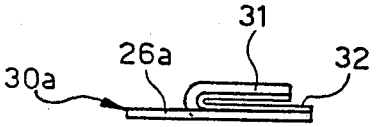
FIGS. 10*a* and 10*b* show plan and sectional views, respectively, still another alternative deionizing arc plate construction.
Figure 11B:
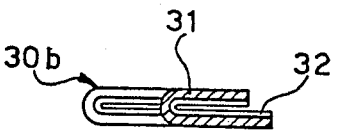
FIGS. 11*a* and 11*b* are plan and sectional views, respectively, of yet another deionizing arc plate construction.
Figure 10A:
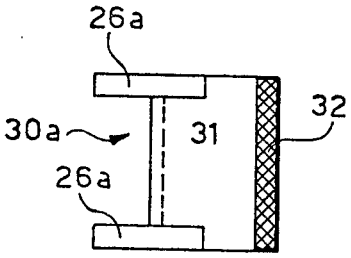
Figure 11A:
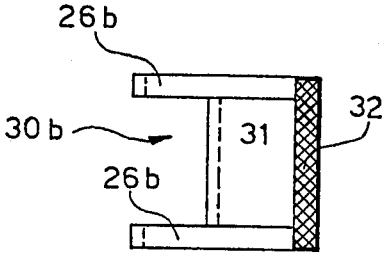

One manner of further reducing thermal stress of the deionizing plates 30 and at the same time increase the electrical resistance inserted into the arc current path is to provide the plates with perforations 33 and 33*a* in the arms thereof, as seen in FIGS. 9*a* and 9*b*. This is found effective in forcing the footpoints of the arc to pursue a sinuous path, over a larger surface. Moreover, the arc current in the plates which must follow a longer path of larger electrical resistance to enhance the build-up of arc voltage leading to more rapid extinction.

Other forms of deionizing plates which induce the arc drawn between the contacts to enter the arc chute 20 are constituted by the plates 30*a* and 30*b* shown in FIGS. 10*a*, 10*b* and 11*a*, 11*b*, respectively. These plates are provided with two horns of a simple type, 26*a*, or bent-type horns 26*b* which act like the magnetic plates 26 of arc motoring assembly 18 in propelling the arc toward and between the deionizing arc plates 30.

Figure 12:
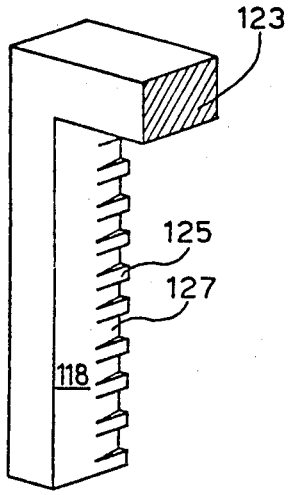
FIG. 12 is a perspective view of one lateral column of an alternative arc motoring assembly.

The latter type of deionizing plates may be utilized in conjunction with the assembly 118 of FIG. 12, having columns flanking the contacts 12 and 14 and composed of a synthetic or ceramic material 123, active with respect to the arc, such as explained below. The material acts under the effects of the high temperatures of the arc to release a cloud of vapors or gases under pressure such as to push the arc into the arc quenching chute 20. The channels 127 formed between the solid portions 125 are placed opposite the spaces between adjacent deionizing plates, which enhances the introduction of the vapors or gases emitted by the material into the chute 20. The presence of magnetic horns 26*a* or 26*b* as per FIGS. 10 and 11 enhances the blowing out of the arc into the chute 20.

Figure 13:
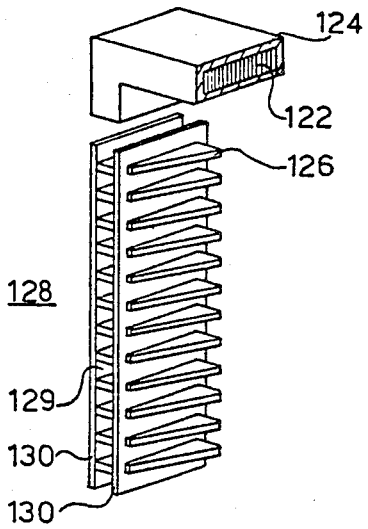
FIG. 13 shows one lateral magnetic arc motoring assembly column constructed in accordance with an alternative embodiment of the invention.

Another form of arc motoring assembly 128 flanking the contacts is illustrated in FIG. 13. This assembly contains a transverse magnetic yoke 122 covered with insulating material 124 similar to assembly 18. Moreover, it contains a series of fins 126 composed of a ferromagnetic, electrically conducting material and separated from one another by an air space 129. The fins are supported by two walls 130 of insulating material. The assembly 128, in its function, resembles the assembly 18 and provides greater cooling.

Figure 14:
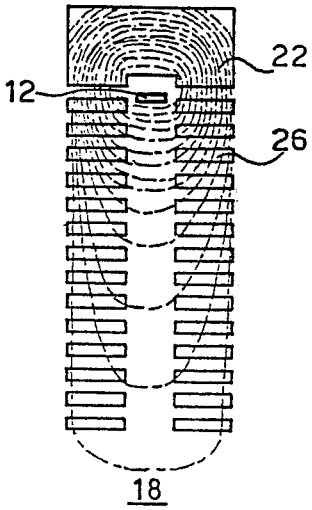
FIG. 14 illustrates the electromagnetic or "slot" effect on the movable contact arm of the circuit breaker of FIG. 1.
Figure 15:
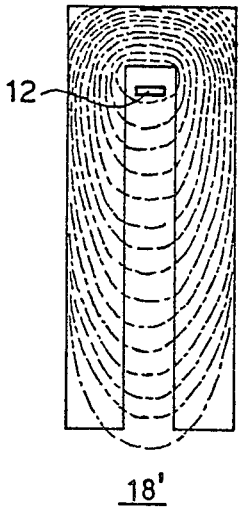
FIG. 15 illustrates the electromagnetic or "slot" effect on a movable contact arm achieved by prior art constructions.

Comparing FIGS. 14 and 15, the advantages of assembly 18 of the present invention (FIG. 14) in its electromagnetic action on the movable contact arm 12 and the arc over the prior art approach embodied in assembly 18' (FIG. 15) will be understood. The electromagnetic effect on movable arm 12, or "slot effect", by means of which a force is exerted on the movable contact arm in the opening direction is of special importance after the contacts have parted, i.e., when the direct electrodynamic action of repulsion between the elongated current-carrying members (arms 12 and 14) becomes relatively less intense. Under these circumstances, saturation of the yoke 22 is obtained, even in case of currents of relatively low intensities. The insulated plates 26 flanking the arc facilitate the distribution of flux density between the columns (FIG. 14) such that the higher density will exist near the yoke, causing a greater opening force to be exerted on the movable contact arm 12 and increased motivation of that section of the arc adjacent the movable contact.

Contrasted with the above, in the case of prior art magnetic structure without gaps in the lateral columns, such as illustrated at 18' in FIG. 15, the distribution of flux density is more uniform along the depth of the slot and thus the electromotive force acting on the movable contact arm in the opening direction does not increase with contact separation. Moreover, the magnetic blowout force exerted on the section of the arc adjacent the movable contact is less.

The electromagnetic action of the "slot effect" of the assembly 18 is added to the electrodynamic action of repulsion between contact arms 12 and 14. The electrodynamic action diminishes substantially as the contacts become separated whereas the slot effect of the assembly 18 of the present invention tends to increase and to compensate for the decrease of the electrodynamic action. As explained above, in the assembly 18' of the prior art, there is no increase in the opening force due to the slot effect. The same is true for the effect of magnetic blowing-out of the arc associated with the moving contact, in that, with the assembly 18 of the present invention, magnetic blowout is relatively much more intense.

It follows from the foregoing that the present invention achieves a much more rapid opening of the breaker contacts and thus a shorter interruption time plus a shorter arcing time, all contributing to an improved current-limiting circuit breaker of higher current interrupting capacity.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A current limiting circuit breaker comprising, in combination:

first and second contacts;

first and second elongated current carrying arms respectively carrying adjacent their corresponding one ends said first and second contacts, at least said first arm being movable with respect to said second arm between a closed position in closely spaced, substantially parallel relation with said second arm and with said first and second contacts in engaged relation and an open position with said first and second contacts in separated relation;

an arc chute positioned in confronting relation with said first and second contacts and including a stack of closely spaced, generally parallel ferromagnetic arc plates arrayed along the path travelled by said first contact during opening movement of said first arm, each said arc plate comprised of a thin metallic sheet of relatively high electrical resistivity formed in a U-shaped configuration to provide a pair of closely spaced arms joined by a curved portion disposed in contiguous relation with said travel path of said first contact at one end, said arms having offset terminations at an opposite end, and including a thin electrically insulative sheet interposed between said arms to force arc current to flow along the U-shaped path created by said metallic sheet; and arc motivating means disposed in confronting relation with said arc chute and including a pair of columns flanking said travel path of said first contact, said columns cooperating with said arc plates as said first arm moves to its open position to promote rapid movement of a consequent arc drawn between said contacts into said arc chute to be split up and cooled by said arc plates.

2. The current limiting circuit breaker defined in claim 1, wherein each said column includes ferromagnetic material operative while said first arm is moving from its closed position to its open position to achieve magnetic motoring of the arc into said arc chute.

3. The current limiting circuit breaker defined in claim 2, wherein each said column includes a stack of spaced, ferromagnetic plates arranged in parallel relation with each other and in generally parallel relation with said arc plates of said arc chute.

4. The current limiting circuit breaker defined in claims 2 or 3, wherein said arc motivating means further includes a yoke of ferromagnetic material spanning corresponding one ends of said columns to create a closed slot in which said first contact travels as said first arm moves between its open and closed positions, said yoke being in flux coupling relation with said columns.

5. The current limiting circuit breaker defined in claim 3, wherein said plates of each said column are embedded in an electrically insulative material, said columns providing a confinement zone for an arc drawn between said first and second contacts.

6. The current limiting circuit breaker defined in claims 1 or 2, wherein at last the portions of said columns disposed along said travel path of said first contact are surfaced with an electrically insulative material, thereby providing a confinement zone for an arc drawn between said first and second contacts, said insulative material being capable of evolving a gas in the presence of an arc effective in pneumatically propelling the arc into said arc chute.

7. The current limiting circuit breaker defined in claims 1, 2 or 3, wherein said insulative sheet is in the form of an insulative layer laminated to each said arc plate prior to the formation of its U-shape.

8. The current limiting circuit breaker defined in claims 1, 2 or 3, wherein said arc plates are perforated in a manner to elongate the U-shaped arc current path therethrough.

9. The current limiting circuit breaker defined in claim 1, wherein said insulative sheet is in the form of an insulative layer laminated to each said arc plate prior to the formation of its U-shape, each said arc plate being further integrally formed having a pair of horns disposed with said columns in flanking relation with said travel path of said first contact.

10. A current limiting circuit breaker comprising, in combination:

first and second contacts;

first and second elongated current carrying arms respectively carrying adjacent their corresponding one ends said first and second contacts, at least said first arm being movable with respect to said second arm between a closed portion in closely spaced, substantially parallel relation with said second arm and with said first and second contacts in engaged relation and an open position with said first and second contacts in separated relation;

an arc chute positioned in confronting relation with said first and second contacts and including a stack of closely spaced generally parallel ferromagnetic arc plates arrayed along the path travelled by said first contact during opening movement of said first arm; and a magnetic assembly confronting said arc chute and including a pair of columns flanking said travel path of said first contact, each said column including a stack of spaced, ferromagnetic plates arranged in parallel relation with each other and in generally parallel relation with said arc plates of said arc chute said plates of each of said column are embedded in an electrically insulative material, said columns providing a confinement zone for an arc drawn between said first and second contacts.

11. The current limiting circuit breaker defined in claim 10, wherein said magnetic assembly further includes a yoke of ferromagnetic material spanning corresponding one ends of said columns to create a closed slot in which said first arm moves between its open and closed positions, said yoke being in flux coupling relation with said column plates.

12. The current limiting circuit breaker defined in claims 10 or 11, wherein, at least in said confinement zone, said insulative material is capable of evolving a gas in the presence of an arc.

13. The current limiting circuit breaker defined in claim 10 wherein said arc plates each comprise a thin metallic sheet of relatively high electrical resistivity formed in a U-shaped configuration to provide a pair of closely spaced arms joined by a curved portion disposed in contiguous relation with said travel path of said first contact at one end and including a thin electrically insulative sheet interposed between said arms to force arc current to flow along the U-shaped path created by said metallic sheet.

* * * * *